US009541097B1

(12) United States Patent
Boyd

(10) Patent No.: US 9,541,097 B1
(45) Date of Patent: Jan. 10, 2017

(54) HUB ASSEMBLY FOR A LARGE COOLING FAN

(71) Applicant: MACROAIR TECHNOLOGIES, INC., San Bernardino, CA (US)

(72) Inventor: Edward K. Boyd, Grand Terrace, CA (US)

(73) Assignee: Macroair Technologies, Inc., San Bernardino, CA (US)

( * ) Notice: Subject to any disclaimer, the term of this patent is extended or adjusted under 35 U.S.C. 154(b) by 365 days.

(21) Appl. No.: 14/075,988

(22) Filed: Nov. 8, 2013

Related U.S. Application Data

(63) Continuation of application No. 12/770,605, filed on Apr. 29, 2010, now Pat. No. 8,579,588.

(60) Provisional application No. 61/173,904, filed on Apr. 29, 2009.

(51) Int. Cl.
*F04D 29/34* (2006.01)
*F04D 29/64* (2006.01)

(52) U.S. Cl.
CPC ..... *F04D 29/646* (2013.01); *F04D 29/34* (2013.01)

(58) Field of Classification Search
CPC ..... F04D 25/088; F04D 29/34
See application file for complete search history.

(56) References Cited

U.S. PATENT DOCUMENTS

| | | | |
|---|---|---|---|
| 399,973 | A | 3/1889 | Cassidy |
| 681,710 | A | 9/1901 | Kemmerer |
| 921,744 | A | 5/1909 | Scott |
| 1,642,205 | A | 9/1927 | Hosch |
| 2,135,700 | A | 11/1938 | Cierva |
| 2,312,095 | A | 2/1943 | Welty |
| 2,450,440 | A | 10/1948 | Mills |
| 2,736,137 | A | 2/1956 | Thaheld |
| 2,906,349 | A | 9/1959 | Hans et al. |
| 3,033,049 | A | 5/1962 | Morrow |
| 3,051,072 | A | 8/1962 | Bohanon |
| 3,161,239 | A | 12/1964 | Andersen |
| 3,689,971 | A | 9/1972 | Davidson |
| 3,768,546 | A | 10/1973 | Shipes |
| 3,818,813 | A | 6/1974 | Freeman |
| 4,008,007 | A | 2/1977 | Shipes |

(Continued)

FOREIGN PATENT DOCUMENTS

| | | | |
|---|---|---|---|
| JP | 357110796 | A | 7/1982 |
| JP | 362243990 | A | 10/1987 |
| JP | 405157092 | A | 6/1993 |

OTHER PUBLICATIONS

AF-3000 Compact AC Inverter Brochure, Catalog 10.091.50.003, Sumitomo Machinery Corp of America, Chesapeake VA.

(Continued)

*Primary Examiner* — Igor Kershteyn
(74) *Attorney, Agent, or Firm* — Knobbe Martens Olson & Bear LLP

(57) ABSTRACT

A fan assembly having a motor with a shaft. A hub member is mounted to the shaft so as to be rotated thereby. The hub member defines slots that receive arm members in the slots. The arm members are secured via bolts or other fasteners in the slots and can be replaced if broken or worn. Fan blades are positioned over or otherwise mounted to the arm members. The fan blades and the arm members can be contoured to engage with each other along the length of the arm members so that force is transmitted therebetween.

8 Claims, 11 Drawing Sheets

(56) References Cited

U.S. PATENT DOCUMENTS

| | | | |
|---|---|---|---|
| 4,181,690 | A | 1/1980 | Neu |
| 4,202,655 | A | 5/1980 | Maloof |
| 4,275,993 | A | 6/1981 | Sprengling |
| 4,352,633 | A | 10/1982 | Tassen |
| 4,373,241 | A | 2/1983 | Maloof |
| 4,655,122 | A | 4/1987 | McCabe |
| 4,779,671 | A | 10/1988 | Dolison |
| 4,892,460 | A | 1/1990 | Volk |
| 4,941,803 | A | 7/1990 | Wainauski et al. |
| 4,971,521 | A | 11/1990 | Atarashi et al. |
| 5,088,665 | A | 2/1992 | Vijgen et al. |
| 5,226,783 | A | 7/1993 | Mita |
| 5,246,343 | A | 9/1993 | Windsor et al. |
| 5,328,329 | A | 7/1994 | Monroe |
| 5,492,448 | A | 2/1996 | Perry et al. |
| 5,533,865 | A | 7/1996 | Dassen et al. |
| 5,542,819 | A | 8/1996 | Bucher et al. |
| 5,567,200 | A | 10/1996 | Swartzendruber |
| 5,795,220 | A | 8/1998 | Core |
| 5,860,788 | A | 1/1999 | Sorensen |
| 5,873,701 | A | 2/1999 | Shiu |
| 5,927,945 | A | 7/1999 | Chen |
| 5,984,640 | A | 11/1999 | Wang |
| 6,010,307 | A | 1/2000 | McCabe |
| 6,027,310 | A | 2/2000 | Kerr et al. |
| 6,039,541 | A | 3/2000 | Parker et al. |
| 6,059,531 | A | 5/2000 | Tai |
| 6,062,816 | A | 5/2000 | Chang |
| 6,132,181 | A | 10/2000 | McCabe |
| 6,149,388 | A | 11/2000 | Liao |
| 6,200,099 | B1 | 3/2001 | Liao |
| 6,224,821 | B1 | 5/2001 | Kibble et al. |
| 6,244,820 | B1 | 6/2001 | Yilmaz |
| 6,244,821 | B1 | 6/2001 | Boyd et al. |
| 6,347,924 | B1 | 2/2002 | Chang |
| 6,390,777 | B1 | 5/2002 | Kerr, Jr. |
| 6,431,834 | B1 | 8/2002 | Lackey et al. |
| 6,558,124 | B2 | 5/2003 | Bucher et al. |
| 6,589,016 | B2 | 7/2003 | Boyd et al. |
| 6,619,919 | B2 | 9/2003 | Kerr, Jr. |
| 6,699,014 | B1 | 3/2004 | Lam et al. |
| 6,709,238 | B2 | 3/2004 | Marshall |
| 6,733,242 | B2 | 5/2004 | Yung |
| 6,817,835 | B2 | 11/2004 | Boyd et al. |
| 6,877,703 | B2 | 4/2005 | Tang |
| 6,881,037 | B2 | 4/2005 | Marshall |
| 6,939,108 | B2 | 9/2005 | Boyd et al. |
| 7,726,945 | B2 | 6/2010 | Grant et al. |
| 7,955,055 | B1 | 6/2011 | Boyd et al. |
| 2008/0014092 | A1 | 1/2008 | Aynsley |
| 2009/0123284 | A1* | 5/2009 | Madsen ..... F04D 25/088 416/36 |

OTHER PUBLICATIONS

Janus, J.M. "Analysis of Industrial Fan Designs with Gurney Flaps", 38$^{th}$ Aerospace Sciences Meeting and Exhibit, Jan. 10-13, 2000/Reno, Nevada AIAA-2000-0983, pp. 1-9.

* cited by examiner

HUB ASSEMBLY FOR A LARGE COOLING FAN

INCORPORATION BY REFERENCE TO ANY RELATED APPLICATIONS

Any and all applications for which a foreign or domestic priority claim is identified in the Application Data Sheet as filed with the present application are hereby incorporated by reference under 37 CFR 1.57.

This application is a continuation of U.S. patent application Ser. No. 12/770,605, filed Apr. 29, 2010, which claims the benefit of priority of U.S. Provisional Patent Application 61/173,904, filed Apr. 29, 2009, the disclosures of which are hereby incorporated by reference in their entirety.

BACKGROUND OF THE INVENTION

Field of the Invention

The present invention relates to large cooling fans and, in particular, concerns a hub assembly for large cooling fans.

Description of the Related Art

Cooling fans are often used in industrial applications. In some industrial spaces, the ability to use air conditioning is reduced due to ventilation concerns. For example, in buildings where welding or other oxidizing processes are performed, it may be necessary to have the building open to the outside air for ventilation purposes.

To address these concerns, large industrial fans have been developed. One such example of a large industrial fan is disclosed in U.S. Pat. No. 6,244,821 ('821) to Walter Boyd et al. The fan disclosed in the '821 patent is a large fan having air foil shaped blades that can exceed 8 feet in length. It is particularly adapted to be mounted on the ceiling of an industrial space to provide a cooling airflow for a large volume interior space. The fan in the '821 patent can also be adapted for wall mounting as well.

One issue that occurs with fans with very large blades is that the mounting between the fan blades and an associated hub can be complicated. As the size and weight of the blades of the fan are large, the resultant forces on the hub can be significant. It is desirable that the hub and the interconnection between the blades and the hub be sufficiently strong so as to retain the blades on the hub during normal operation as blades falling off the fan can represent a significant hazard.

This problem is often exacerbated by the environment in which the fans are used. Typically, these fans are used inside buildings that are exposed to the outside air. Wind gusts and the like can exert significant forces on the blades of the fan causing the blades to be more prone to break, often at the point of attachment to the hub.

In the '821 patent, the hub is formed of a casted metal component that is bolted to the fan blade at a plurality of different locations. The casted hub is formed of a single integrated unit which improves the overall strength of the hub. However, having a casted hub represents a significant increase in the overall cost of the fan assembly. Moreover, when a hub blade does break, the entire hub assembly has to be disassembled and replaced and then reassembled which increases the cost and time of repair.

Further, with existing hubs, the fan blades are bolted at one or two locations to the hub blades. Bolting the fan blades to the hub at discrete locations results in the forces between the hub and the fan blades being concentrated at those discrete locations. This can represent a potential point of failure of the blades with respect to the hub assembly.

From the foregoing, there is a need for an improved fan assembly that is less expensive to manufacture, easier to repair and provides a better system for transmitting forces between the hub assembly and the fan blade.

SUMMARY OF THE INVENTION

The aforementioned needs are satisfied by the fan assembly of the present invention which, in one embodiment, comprises a fan assembly having a mount that is adapted to be installed on the wall of a building and a motor with a shaft attached to the mount. The assembly also includes a hub assembly coupled to the shaft of the motor so that the hub is rotated by the shaft of the motor. In this implementation, the hub assembly includes a main portion that defines a plurality of openings and wherein the hub assembly further includes a plurality of arm members that are detachably mounted within the openings. The assembly also includes a plurality of fan blades having a minimum length of 5 feet, wherein the plurality of fan blades are coupled to the arm members so as to extend outward from the main portion of the hub assembly such that rotation of the motor results in rotation of the fan blades.

By interconnecting the arm members to the hub in a detachable manner, it is easier and less expensive to replace hubs with broken or otherwise damaged arm members. In another implementation, the arm members and the fan blades are contoured so as to engage with each other along some or all of the length of the arm member so that the interactive force between the two can be distributed and not concentrated at the fasteners that secure the members together.

These and other objects and advantages will be described in greater detail below in reference to the drawings.

DETAILED DESCRIPTION OF THE PREFERRED EMBODIMENT

Figure 1:
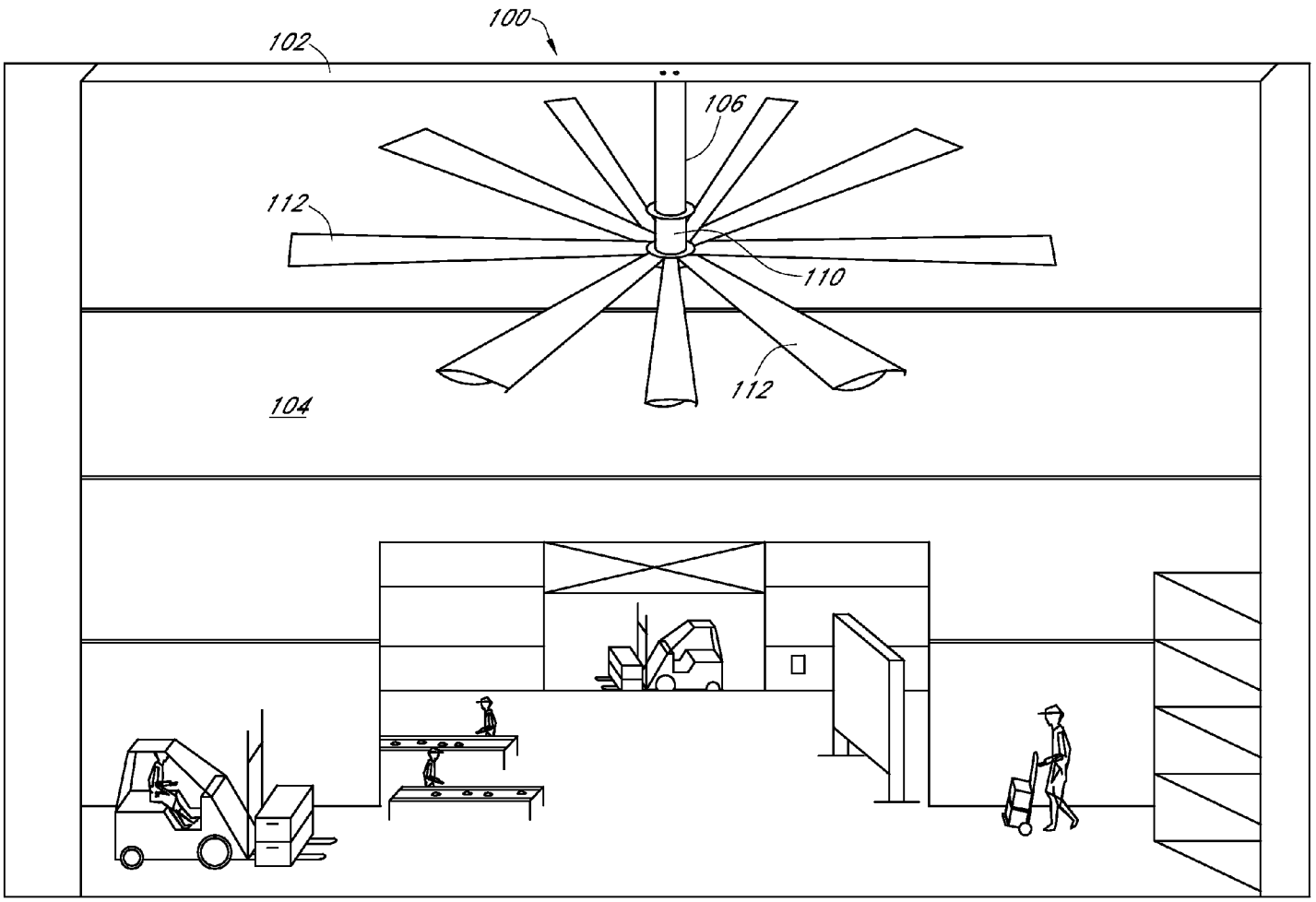
FIG. 1 is a perspective view of an exemplary fan used for cooling the interior of an industrial-type building.

Reference will now be made to the drawings wherein like numerals refer to like parts throughout. FIG. 1 illustrates a fan assembly 100 mounted to an interior wall 102 of a building 104. In this particular implementation, the fan assembly is shown as being mounted to the ceiling, however, it will be appreciated that large industrial-type cooling fans can also be mounted to side walls of the building without departing from the spirit of the present invention. As is generally shown in FIG. 1, the fan assembly includes a motor mount 106 that attaches the fan to the interior wall 102 of the building 104, a hub 110 which is rotatably engaged with the motor mount 106 and a plurality of fan blades 112 that extend radially outward from the hub 110. In this particular implementation, the fan blades extend generally a distance of approximately at least five feet from the hub and, more particularly, at least 10 feet and often 12 feet or more, and the fan preferably rotates at a speed that induces air to be circulated through the building 104 thereby providing cooling effects to the people working below. The fan assembly can be similar to the fan assemblies disclosed in U.S. Pat. No. 6,224,821 and U.S. Pat. No. 6,939,108 which are hereby incorporated by reference in their entirety.

Figure 2A:
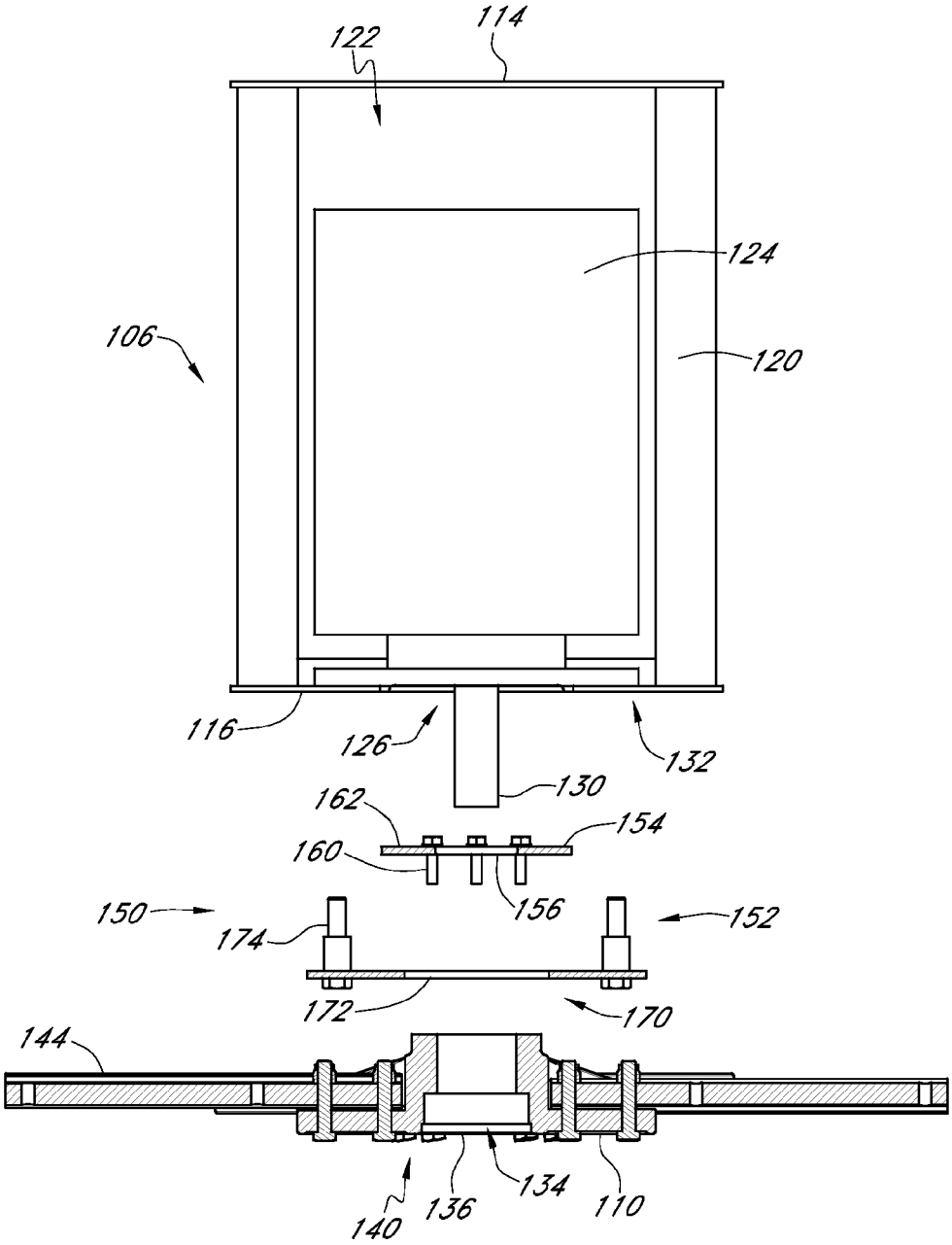
FIG. 2A is an exploded perspective view of one embodiment of a fan having a hub which is attached to the fan blade via arm members.
Figure 2B:
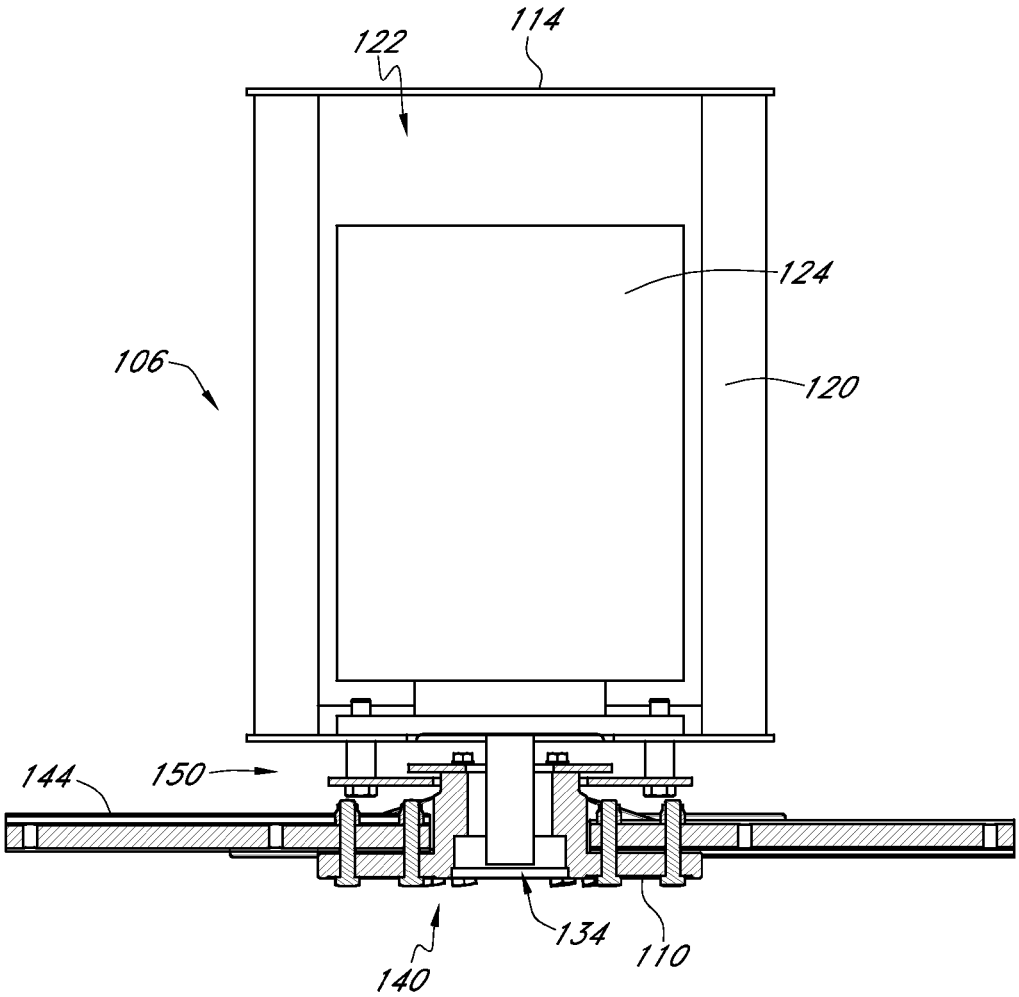
FIG. 2B is an assembled cross-sectional view of the fan of FIG. 2A.
Figure 2C:
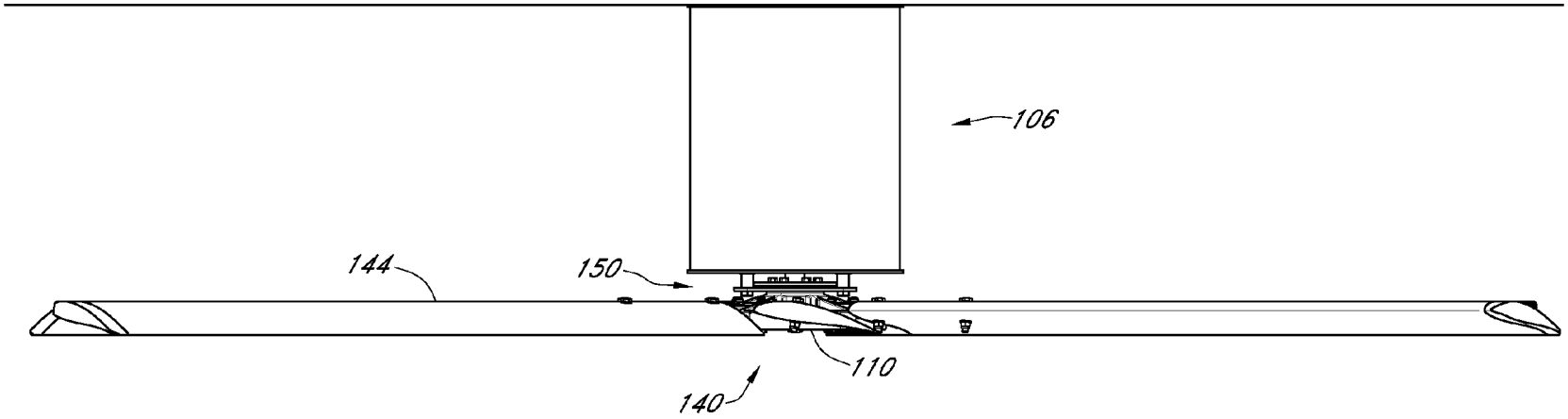
FIG. 2C is an assembled side view of the fan of FIG. 2A.

FIGS. 2A-2C illustrate the fan assembly 100 in greater detail. As is indicated, the fan assembly 100 includes a motor mount 106. In this particular implementation, the motor mount 106 includes two plates 114 and 116 that are spaced apart by a plurality of vertical members 120. The plates 114, 116 and the vertical members 120 can be formed of a strong material such as steel and, when assembled, they define an interior space 122 which is adapted to receive a motor 124 of the fan assembly 100. In particular, the motor 124 is mounted on the lower plate 116 through the use of bolts and the like. Generally, for these types of fans, the motor 124 includes a gear box that translates the motor output into a rotational speed suitable for the fan. The lower plate 116 includes an opening 126 through which a motor shaft 130 extends. The size of the motor and shaft will, of course, vary depending upon the particular size of fan and the implementation of the fan assembly.

As is also illustrated in FIGS. 2A-2C, the fan assembly 100 includes the hub 110 which mounts to the motor shaft 130 adjacent the lower side 132 of the plate 116. Specifically, in this particular implementation, the hub 110 defines a through-going aperture 134 that receives the motor shaft 130 and a locking member 136 that is then attached to the shaft to thereby secure the hub 110 onto the shaft 130 such that when the shaft 130 rotates the hub 110 will, in turn, rotate as well. In one particular implementation, the locking member 136 comprises a flanged collar that is positioned upward through the hub aperture 134 so as to be secured to the motor shaft 130 via friction or fasteners and is further secured to the underside 140 of the hub 110 via fasteners 142 which are shown in phantom in FIG. 2B. The hub includes a plurality of mounting plates 145 to which the fan blades 112 (FIG. 1) attach in a known manner.

As is shown in FIGS. 2A-2C, the motor shaft 130 and the hub 110 define an interface 150 which receives a securing assembly 152 that inhibits the hub from falling when the motor shaft breaks or the hub otherwise disengages from the shaft. In this particular implementation, the securing assembly 152 comprises a first member 154 that has an opening 156 that is sized so that the motor shaft 130 can be positioned therethrough. The first member 154 is adapted to be attached to the hub 110 via fasteners 160, such as bolts. The first member 154 preferably defines a flanged surface 162 that has a first cross-sectional dimension.

The securing assembly shown in FIGS. 2A-2C, further includes a second member 170 that also has an opening 172 that is sized so as to allow the motor shaft 130 to extend therethrough. In this implementation, the opening 172 is also sized so as to allow the fasteners 160 of the first securing member 154 to also extend through the opening 172 and engage with the hub 110 in the previously described fashion. However, the opening is further sized such that the flanged surface 162 of the first member 154 extending in the first cross-sectional dimension is greater than the cross-sectional dimension of the opening 172 such that the first securing member 154 cannot be pushed or pulled through the opening 172. The second securing member 170 is attached to the lower plate 116 of the motor mount by a fastener 174 such as bolts. Hence, in an assembled form, the second member 170 is interposed between the first member 154 and the hub 110. Since the second member 170 is attached to the motor mount 106 and the first securing member 154 is attached to the hub, should the motor shaft 130 break or the hub 110 otherwise disengage from the shaft, the first member 154 will engage with the second securing member 170 thereby preventing the hub and attached fan blades from falling away from the motor mount 106. The securing mechanism is described in Applicant's co-pending patent application entitled Safety Retaining System for Large Industrial Fans filed Apr. 13, 2007, Ser. No. 11/735,290 which is hereby incorporated by reference in its entirety.

As is also shown in FIGS. 2A-2C, the hub 110 includes a plurality of attachable arms 144 that engage with the fan blades 112. As will be described in greater detail below, the arms 144 are bolted or otherwise fastened to the hub 110 which allows for easier replacement of the arms 144 should the arms become damaged. Further, as will be discussed below, the arms 144 engage the fan blades 112 in such a manner that force from the hub 110 is more uniformly transferred to the fan blade 112 along the length of the arm 144 thereby reducing pressure points or stress points on the arm 144 which reduces the likelihood of fatigue and failure of the arm 144 at the connection point.

Figure 3A:
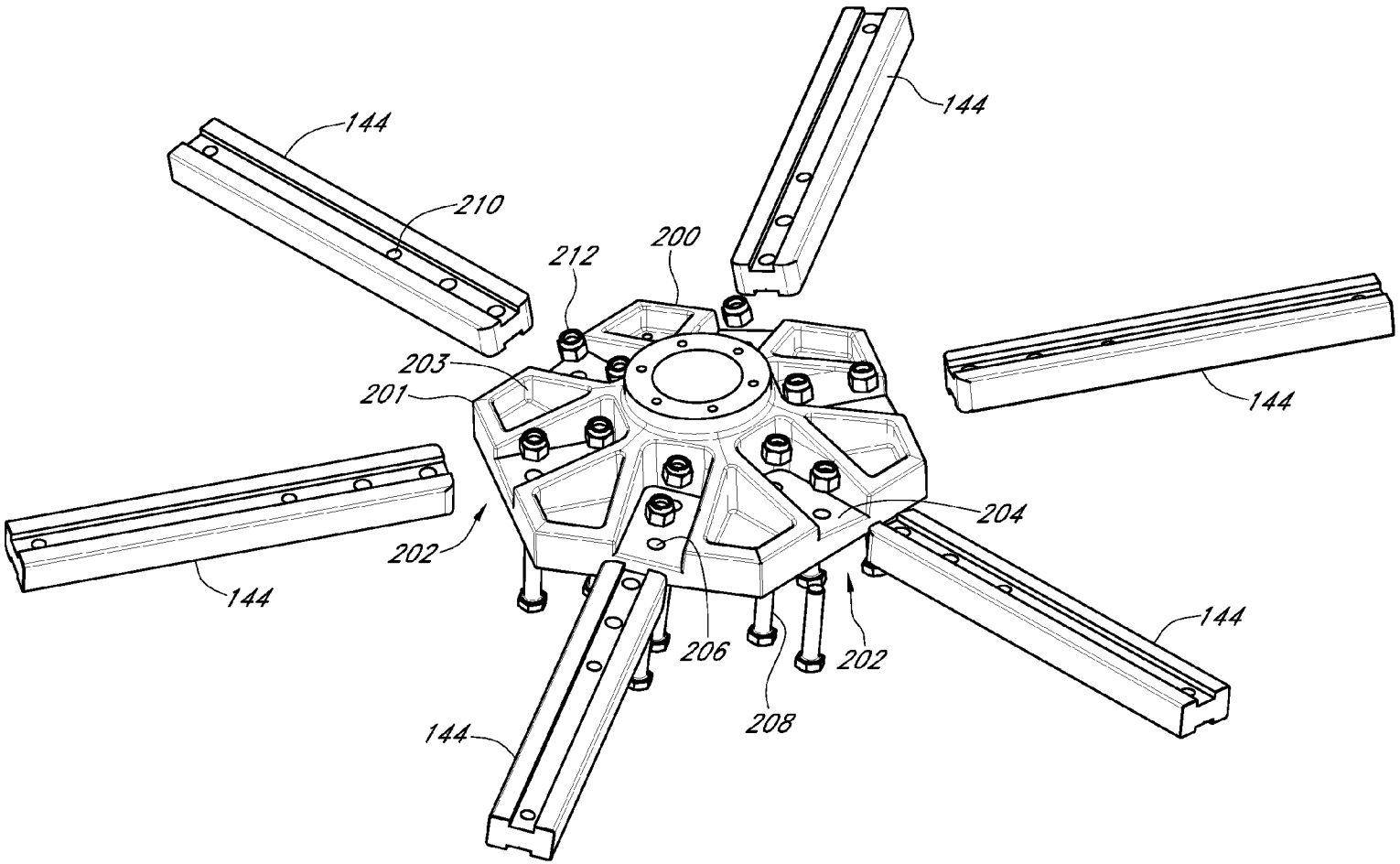
FIG. 3A is an exploded perspective view of a hub assembly that is a component of the fan assembly of FIG. 1.
Figure 3B:
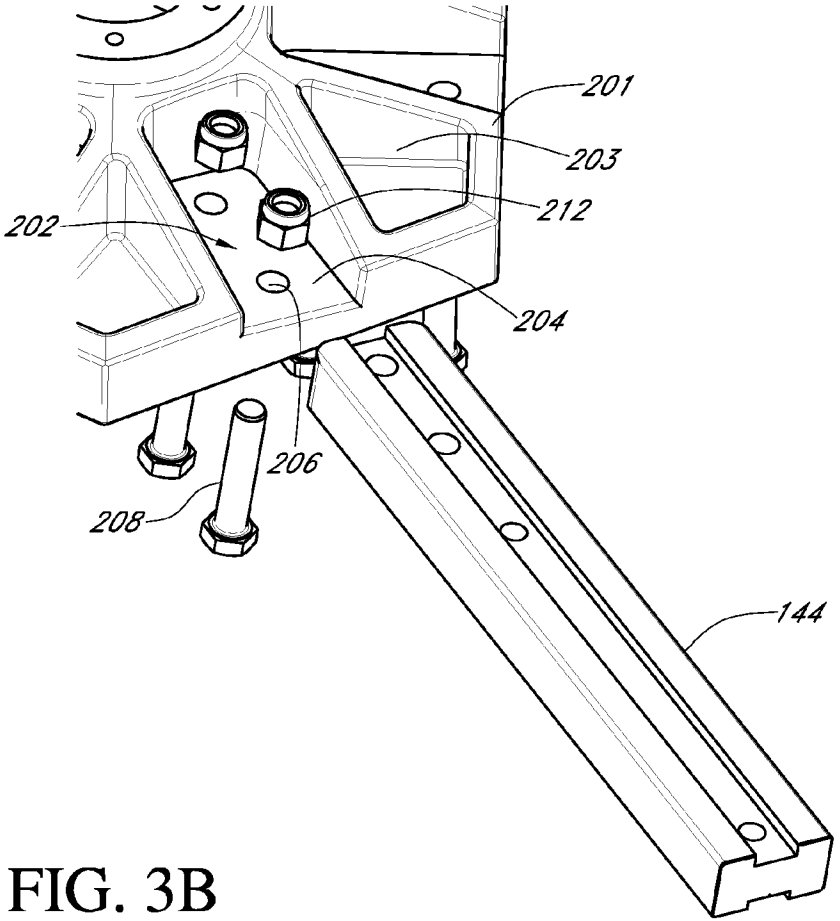
FIG. 3B is a partial exploded perspective view of a part of the hub assembly of FIG. 3A.

The hub 110 is illustrated in greater detail in FIGS. 3A and 3B. As shown, the hub 110 includes a main portion 200 that defines a plurality of slots 202 that receive the arms 144. The main portion 200 of the hub 110 is generally a polygon shape, in this example having six sides, where each side will receive an arm 144. The exact configuration of the main body 200 of the hub 110 can vary depending upon the desired application without departing from the spirit of the present invention. The main portion 200 of the hub 110 is preferably cast of a metal such as steel or aluminum. To save material, the raised portions 201 between adjacent slots 202 include holes 203 that reduce the amount of metal that is needed to form the main portion 200.

The slots 202 are preferably 3 inches long, 1.5 inches wide and have a minimum depth of ⅝ of an inch but these dimensions can vary by application without departing from the scope of the present invention. The arms 144 have a width that is preferably approximately equal to the width of the slots 202 so that the arms 144 are flushly positioned within the slots so that rotational force is transferred between the main body 200 and the arm members 144 by the flush mounting as well as the fasteners interconnecting these parts.

The slots have a bottom surface through which a plurality of through holes 206 are formed. Fasteners, such as bolts 208, extend from a bottom surface 204 of the main portion 200 of the hub 110 through the holes 206 and through holes 210 in the arm 144 wherein nuts 212 can then be used to secure the arms 144 in the slots 202. In this fashion, the arms 144 can be secured to the hub 110 and can also be replaced when damaged or worn without requiring the replacement of the entire hub 110.

Figure 4A:
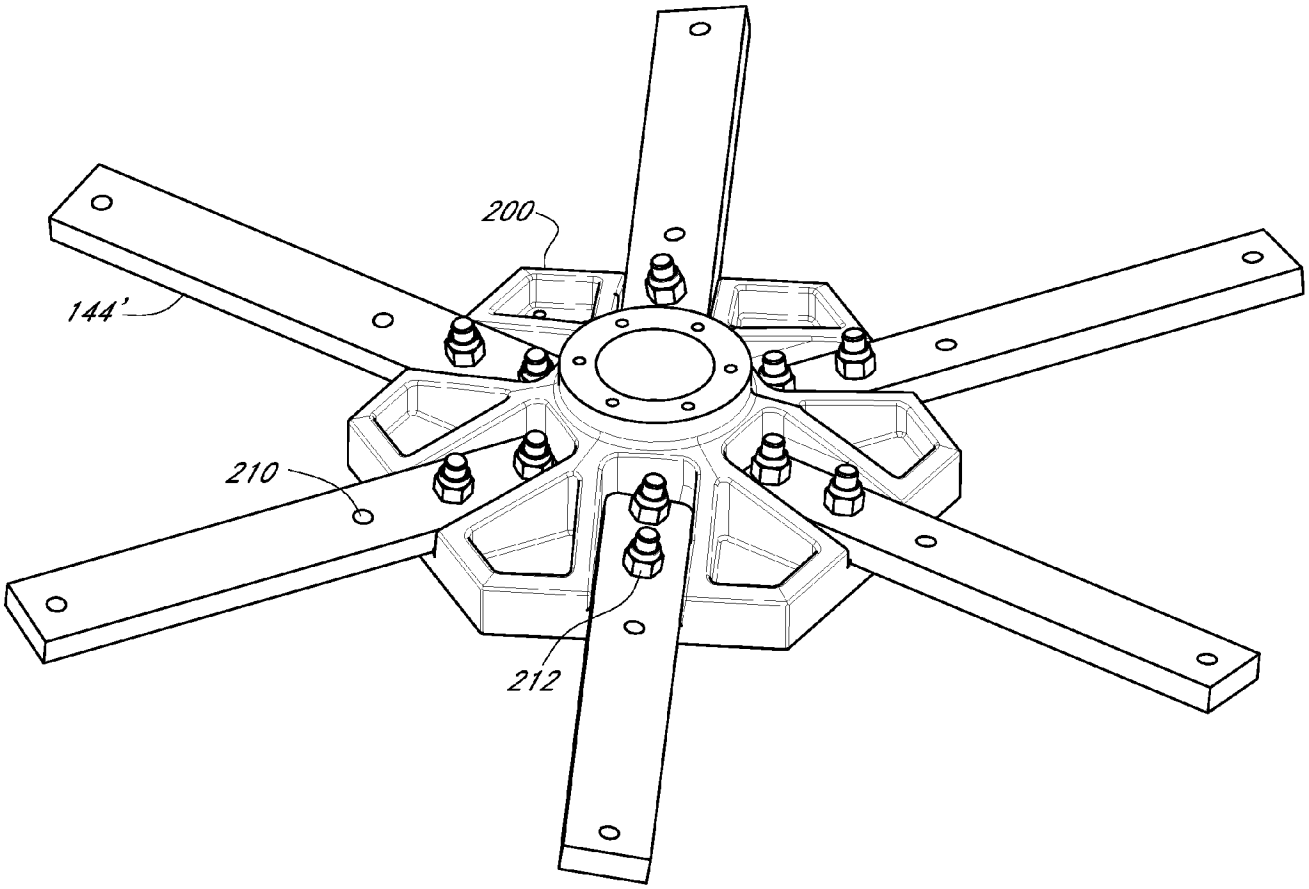
FIGS. 4A and 4B are assembled perspective views of the hub assembly of FIG. 3.
Figure 4B:
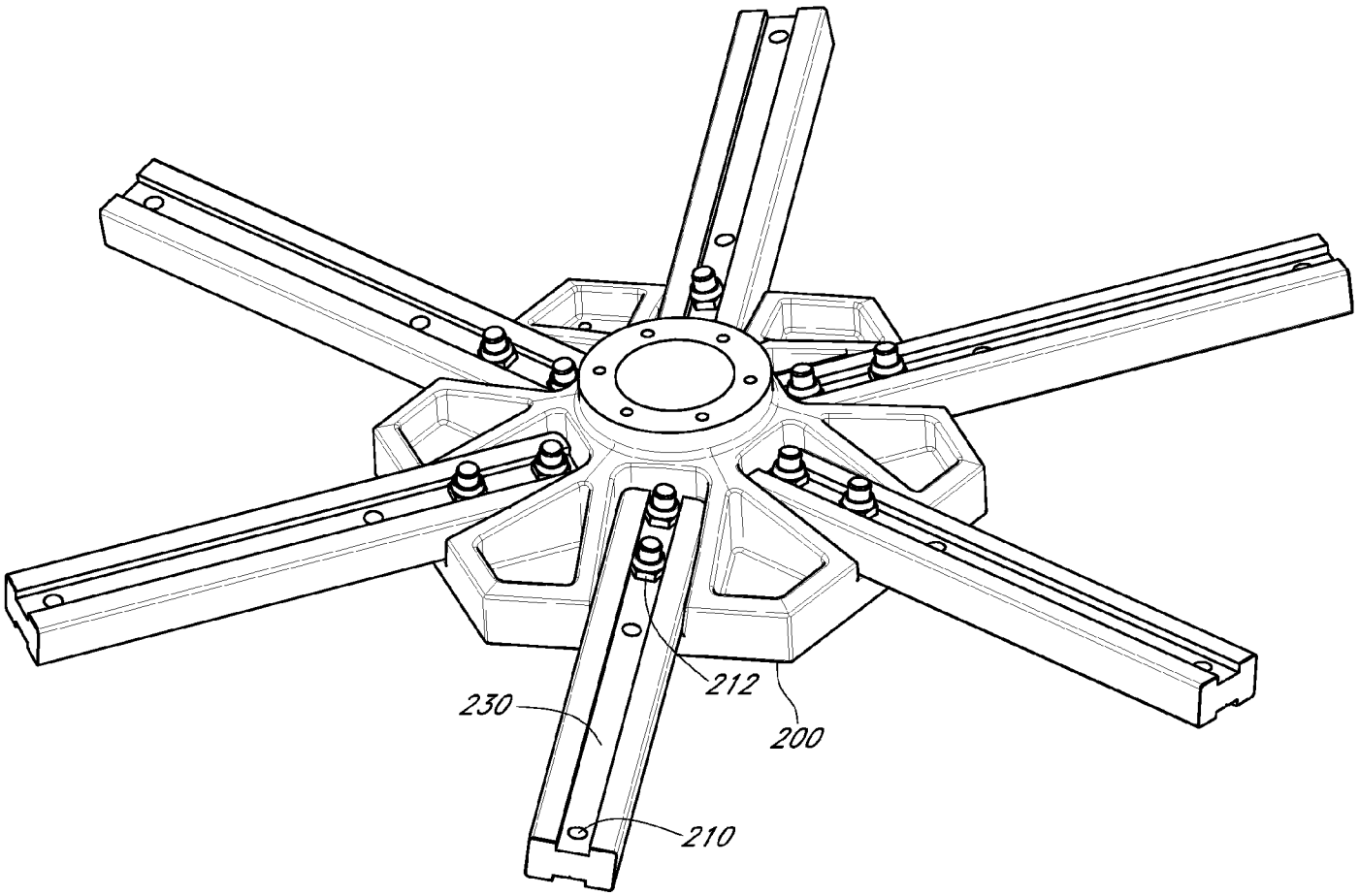

FIGS. 4A and 4B illustrate examples of possible configuration of arms 144. The arms 144 can comprise steel arms 144' or aluminum arms 144". The length of the arms 144 will vary depending upon the application but are commonly 10 inches long for a 144 inch long size fan blade 110.

Figure 5:
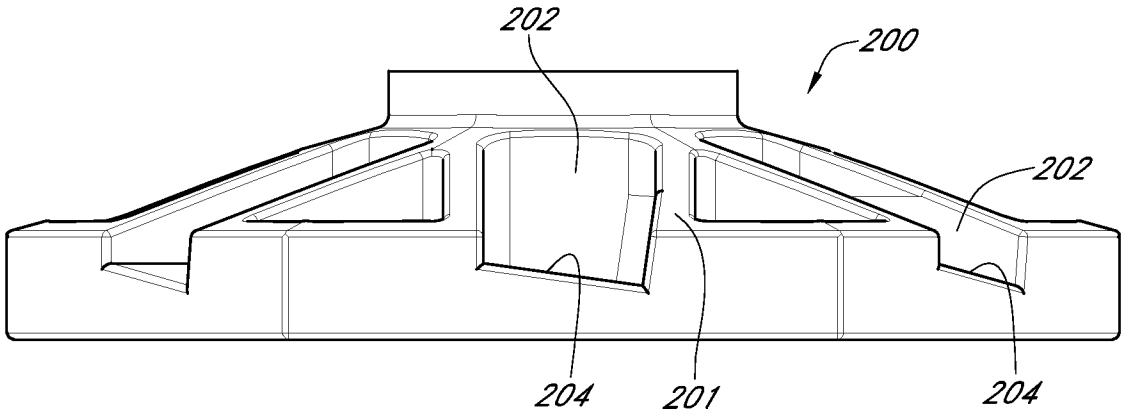
FIG. 5 is a side view of the hub assembly of FIG. 3.

FIG. 5 is a side view of the main portion 200 of the hub 110. As shown, the bottom surface 204 of the slot 202 is angled at a pre-selected angle. This allows the arm member 144 to also be angled at a pre-selected angle and, as described in greater detail below, also allows the fan blade 112 to be mounted to the hub so as to have a pre-selected angle of attack which increases the air flow from the fan. In one particular implementation, the bottom surface is angled at approximately 8 degrees from horizontal although it will be appreciated that the exact angle can be varied depending upon the application.

Figure 6:
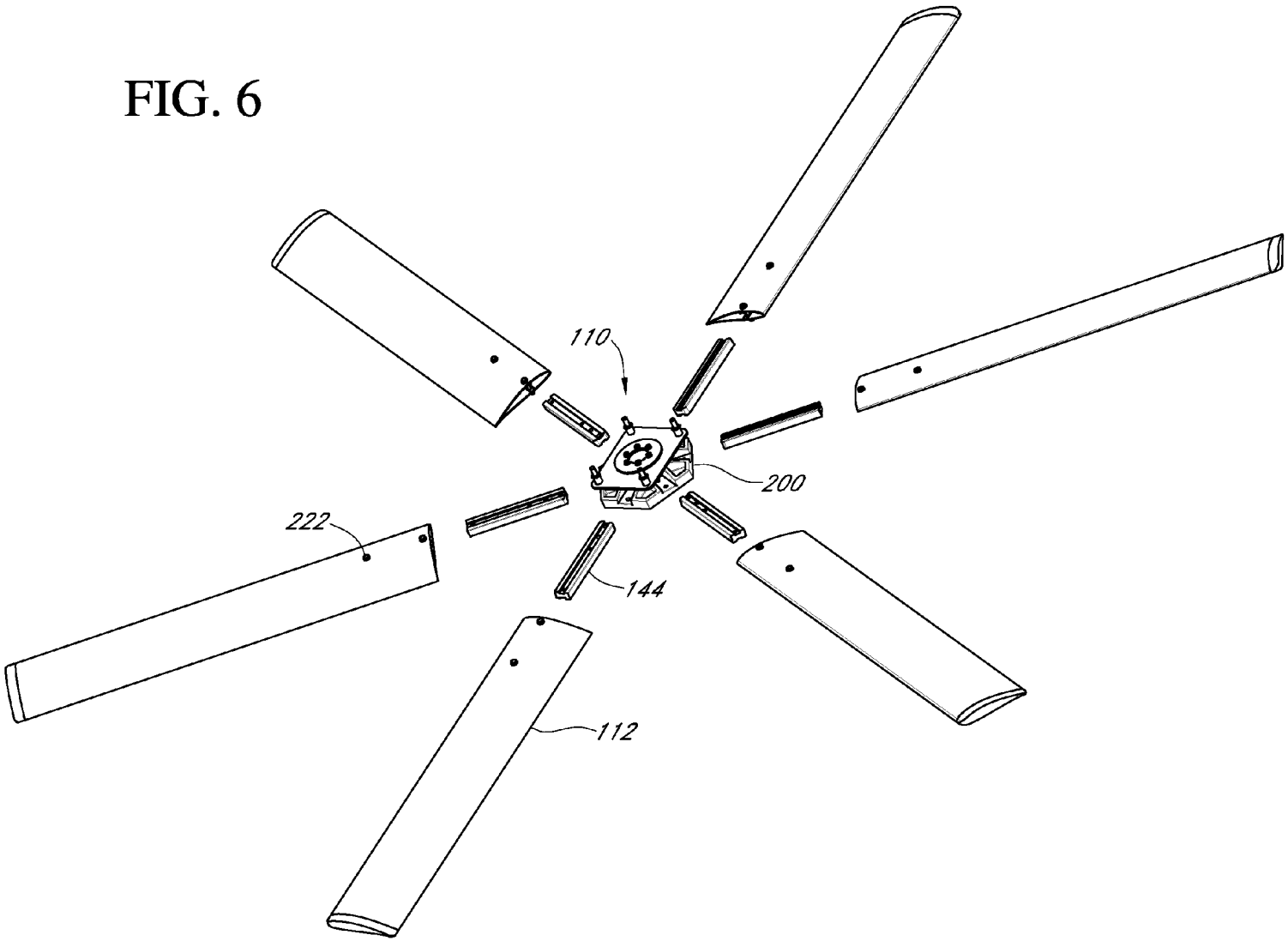
FIG. 6 is a perspective view of the fan assembly of FIG. 1 illustrating how the fan blades are attached to the hub assembly of FIG. 3.

FIG. 6 is an exploded view of a portion of the fan assembly 100 illustrating the manner of interconnection between the fan blades 112 and the hub 110. As shown, the fan blades 112 have an opening 220 that receives the arms 144 so that the fan blade 112 is positioned over the arm 144. The fan blade 112 also preferably has a plurality of securing holes 222 that receive fasteners, such as nuts and bolts, that engage with matching holes 206 formed on the arms 144 so as to secure the blades to the arms 144. The attachment of the blades 112 to the arms 144 can occur either before or after the arms 144 are attached to the main portion 200 of the hub.

Figure 7:
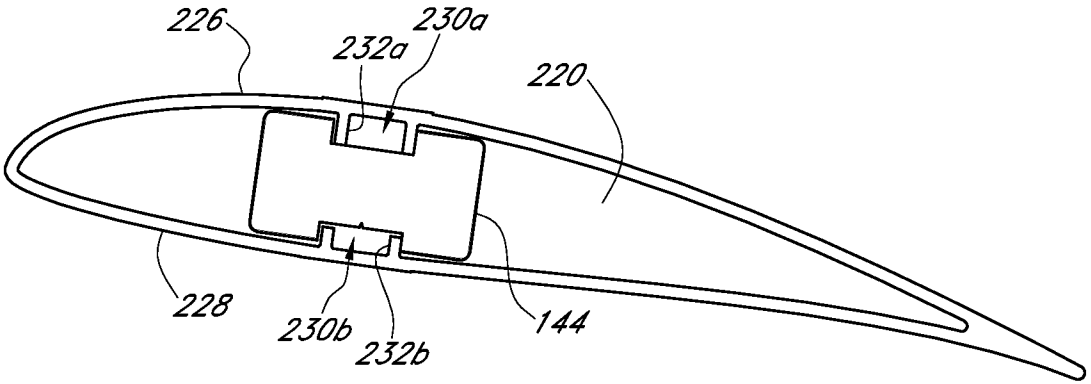
FIG. 7 is a cross-sectional view of the fan blades of the fan assembly of FIG. 1 illustrating the mechanical interconnection between the hub assembly of FIG. 3 and the fan blades.

FIG. 7 illustrates the opening 220 in the fan blade 112 and the interaction with the arm 144 in greater detail. As shown, the fan blade 112 is preferably hollow having the opening 220 that extends the length of the fan. The width of the opening 220 from the top surface 226 to the bottom surface 228 of the fan blade is approximately the width of the cross-sectional dimension of the arm member 144. In this embodiment, the arm member 144 includes indentations 230*a*, 230*b* on the upper and lower surfaces and the fan blade further includes protrusions 232*a*, 232*b* that engage into the indentations 230*a*, 230*b* so that the protrusions engage with the indentations so that mechanical force is transmitted from the arm members 144 to the fan blade 112 substantially along the length of the arm member 144.

The exact configuration of the indentations and protrusions can, of course, vary depending upon the application. The engagement between the fan blade 112 and the arm member 144 along the length or along at least certain portions of the length reduces the forces that are placed on the bolts that engage the fan blades 112 to the arm members 144 via the securing holes 222. This results in less fatigue on this interconnection and reduced failure.

Although the foregoing has shown, illustrated and described various embodiments of the present invention, it will be understood that various changes to the form, the detail, the use and the implementation thereof can be made by those skilled in the art without departing from the spirit of the present invention. Hence, the present invention should not be limited to the foregoing description but should be defined by the appended claims.

What is claimed is:

1. A fan assembly comprising:
   - a mount that is adapted to be installed on the wall of a building;
   - a motor attached to the to the mount, the motor having a shaft;
   - a hub assembly coupled to the shaft of the motor so that the hub is rotated by the shaft of the motor, wherein the hub assembly includes a main portion that defines a plurality of mounting locations and wherein the hub assembly further includes a plurality of arm members that are detachably mounted within the mounting locations;
   - a plurality of fan blades having a minimum length of 5 feet, wherein the plurality of fan blades are coupled to the arm members so as to extend outward from the main portion of the hub assembly such that rotation of the motor results in rotation of the fan blades and
   - wherein the outer surface of the arm members are contoured and the inner surfaces of the fan blades are contoured so that the inner surface of the fan blades engage with the outer surfaces of the arm member so that force is directed from the arm member to the fan blade by the engagement there between the contoured surfaces of the arm members and the fan blades.

2. The assembly of claim 1, wherein the arm members define indentations and the fan blade define protrusions that are positioned within the indentations when the fan is positioned over the arm member that the protrusions engage with the indentations.

3. The assembly of claim 1, wherein the main portion of the hub assembly is a polygonal shape having an opening for each face of the polygon that receives an arm member.

4. The assembly of claim 3, wherein the hub assembly has 6 faces.

5. The assembly of claim 1, wherein the mounting locations of the main portion of the hub assembly are slots that have two side surfaces and a bottom surface and the bottom surface receives the arm members.

6. The assembly of claim 4, wherein the arm members are coupled to the bottom surface by a plurality of fasteners that extend through the bottom surface and the arm members.

7. The assembly of claim 5, wherein the bottom surface of the slots is angled with respect to the horizontal so as to impart an angle of attack onto the fan blade mounted to the arm member that is positioned within the slot.

8. The assembly of claim 6, wherein the bottom surface is angled approximately 8 degrees with respect to the horizontal.

* * * * *